US007011365B2

(12) United States Patent
Kerfoot et al.

(10) Patent No.: US 7,011,365 B2
(45) Date of Patent: Mar. 14, 2006

(54) CHAIR COVER

(76) Inventors: Jessica T. Kerfoot, 6901 CR 26, Rawson, OH (US) 45881; Kathryn A. Klausing, 7205 Lanore St., Waterford, MI (US) 48327

( * ) Notice: Subject to any disclaimer, the term of this patent is extended or adjusted under 35 U.S.C. 154(b) by 0 days.

(21) Appl. No.: 10/842,354

(22) Filed: May 10, 2004

(65) Prior Publication Data

US 2005/0264054 A1 Dec. 1, 2005

(51) Int. Cl.
*A47C 27/00* (2006.01)
*A47C 31/00* (2006.01)

(52) U.S. Cl. ..... 297/219.12; 297/220; 297/225; 297/219.1

(58) Field of Classification Search ..... 297/219.1, 297/228.1, 228.12, 220, 221, 222, 225, 229, 297/485, 440.12, 228
See application file for complete search history.

(56) References Cited

U.S. PATENT DOCUMENTS

| | | | | | |
|---|---|---|---|---|---|
| 2,771,939 | A | * | 11/1956 | Trubitt | 297/228.1 X |
| 2,778,412 | A | * | 1/1957 | Trubitt | 297/228 X |
| 2,793,683 | A | * | 5/1957 | Trubitt | 297/228 |
| D276,103 | S | | 10/1984 | Turner et al. | |
| D303,473 | S | | 9/1989 | Sheinman | |
| D307,995 | S | | 5/1990 | Kelldorf | |
| D331,521 | S | | 12/1992 | Kelldorf | |
| 5,326,152 | A | | 7/1994 | Baron | |
| 5,476,308 | A | * | 12/1995 | St. Germain | 297/229 |
| 5,547,250 | A | * | 8/1996 | Childers | 297/485 |
| 5,690,380 | A | | 11/1997 | Waters | |
| 5,816,654 | A | * | 10/1998 | Ellis | 297/228.1 |
| D444,982 | S | | 7/2001 | LaConte | |
| 6,481,736 | B1 | * | 11/2002 | Chan | 297/229 |
| 6,481,793 | B1 | * | 11/2002 | Horn | 297/228.1 |
| D473,090 | S | | 4/2003 | Trucchi | |

OTHER PUBLICATIONS

Slipcovers For Folding Chairs; Disclosed in Search Report from Davison Design & Development, Inc., Pittsburgh, PA, and printed from Internet on approximately Jul. 28, 2003; 1 Page.

Cotton Duck Folding Chair; Disclosed in Search Report from Davison Design & Development, Inc., Pittsburgh, PA, and printed from Internet on approximately Jul. 28, 2003; 1 Page.

Folding Chair Slipcovers; Disclosed in Search Report from Davison Design & Development, Inc., Pittsburgh, PA, and printed from Internet on approximately Jul. 28, 2003; 1 Page.

Folding Chair Slipcovers; Disclosed in Search Report from Davison Design & Development, Inc., Pittsburgh, PA, and printed from Internet on approximately Jul. 28, 2003; 1 Page.

Folding Chair Styles; Disclosed in Search Report from Davison Design & Development, Inc., Pittsburgh, PA, and printed from Internet on approximately Jul. 28, 2003; 2 Pages.

* cited by examiner

*Primary Examiner*—Anthony D. Barfield
(74) *Attorney, Agent, or Firm*—Harness, Dickey & Pierce, P.L.C.

(57) ABSTRACT

A chair cover is provided including a member defining a curtain portion and a belt portion. The belt portion includes a hood portion, a first arm portion, and a second arm portion. The first arm portion extends from a first edge of the hood portion. The second arm portion extends from a second edge of the hood portion that is opposite the first edge. The hood portion is adapted to engage a seatback of a chair. The skirt portion is adapted to cover a backside of the chair. The first and second arm portions are adapted to be fixed together behind the seatback of the chair.

15 Claims, 3 Drawing Sheets

CHAIR COVER

FIELD OF THE INVENTION

The present invention relates to a decorative covering and, more particularly, a decorative covering for a seating device.

BACKGROUND OF THE INVENTION

Folding metal chairs are widely used for various events. These chairs are highly practical because they are fairly comfortable and they collapse into an easily transferable and storable configuration. However, because folding metal chairs are so easily collapsed and stored, they often become dented and paint on their exterior may chip. This can make for visually unpleasant chairs. One solution has been to cover the chairs with a typical seat cover, which includes a hood portion and a skirt portion. The hood portion covers the seat back and the skirt portion covers the seat bottom and extends down to cover the legs of the chair. These types of seat covers are typically constructed of a fabric such as cotton or linen and tend to be relatively expensive. Such expense may deter a consumer that is seeking to meet a budget or desires a chair cover for a one-time use.

SUMMARY OF THE INVENTION

A chair cover is provided including a one-piece flexible member defining a curtain portion and a belt portion. The belt portion includes a hood portion, a first arm portion, and a second arm portion. The first arm portion extends from a first edge of the hood portion. The second arm portion extends from a second edge of the hood portion that is opposite the first edge. The hood portion is adapted to engage a seatback of a chair. The skirt portion is adapted to cover a backside of the chair. The first and second arm portions are adapted to be tied together behind the seatback of the chair.

Another aspect of the present invention provides a decorative chair including a seat bottom, a seatback, and a one-piece flexible member. The seatback includes a seating face and a back face opposite the seating face. The seatback is supported generally upright on the seat bottom. The one-piece flexible member includes a curtain portion and a belt portion. The curtain portion covers the back face of the seatback. The belt portion includes a hood portion and a pair of arm portions. The hood portion removably engages the seating face of the seatback. The pair of arm portions extend from opposite sides of the hood portion. The arm portions are tied together behind the curtain portion of the cover and the back face of the seatback to maintain the hood portion in engagement with the seating face.

Another aspect of the present invention provides a chair covering product. The chair covering product includes a first flexible member, a second flexible member, a first perforated seam, and a second perforated seam. The first flexible member includes a first curtain portion and first and second opposing arm portions. The second flexible member includes a second curtain portion and third and fourth opposing arm portions. The first perforated seam is disposed between the first curtain portion of the first flexible member and one of the third and fourth arm portions of the second flexible member. The second perforated seam is disposed between the second curtain portion of the second flexible member and one of the first and second arm portions of the first flexible member.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the scope of the invention, its application, or its uses. It should be appreciated that the dimensions and proportions described herein are merely exemplary of a decorative covering for a chair and that alternative dimensions and/or proportions adapted for use with a bench, sofa, or like seating device are intended to be within the scope of the present invention.

Figure 1:
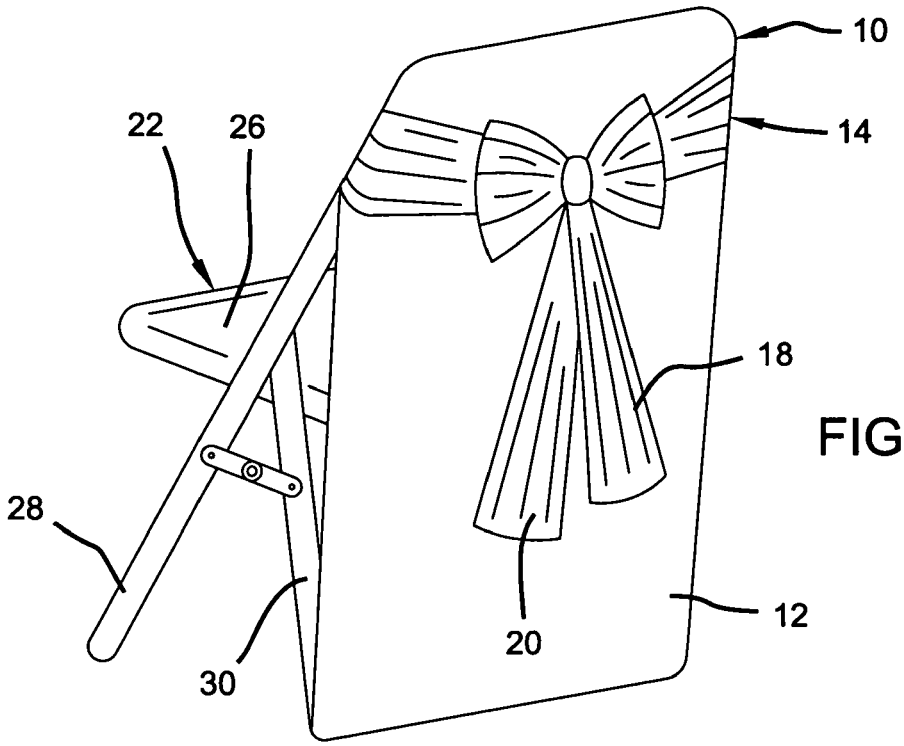
FIG. 1 is a first isometric view of a chair cover assembled onto a chair in accordance with the principles of the present invention.
Figure 2:
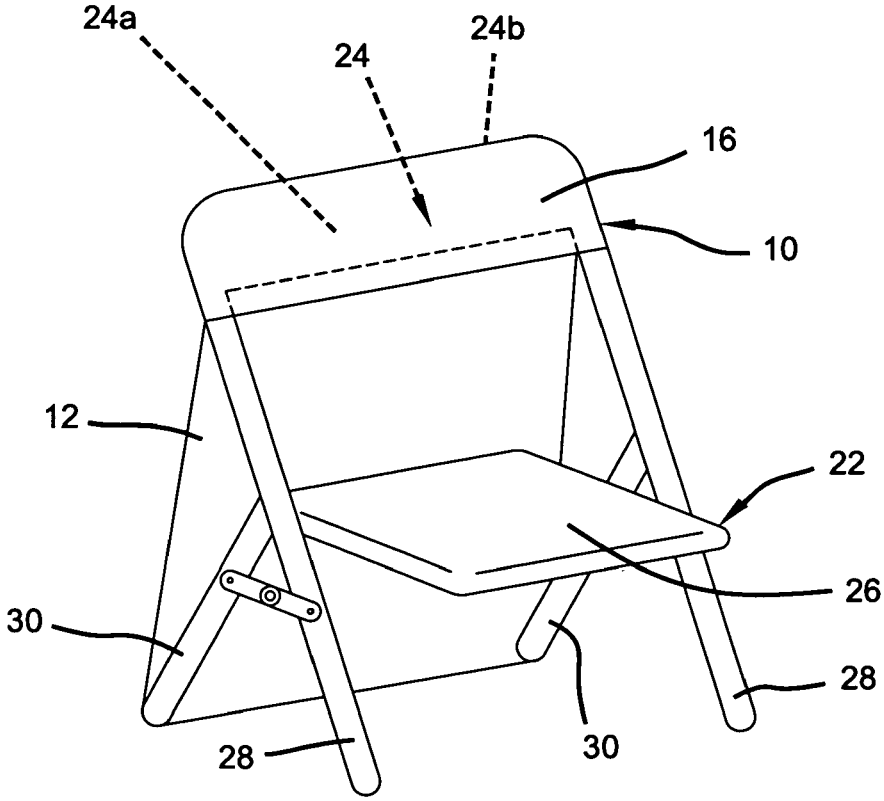
FIG. 2 is a second isometric view of the chair cover of FIG. 1 assembled onto a chair.
Figure 3:
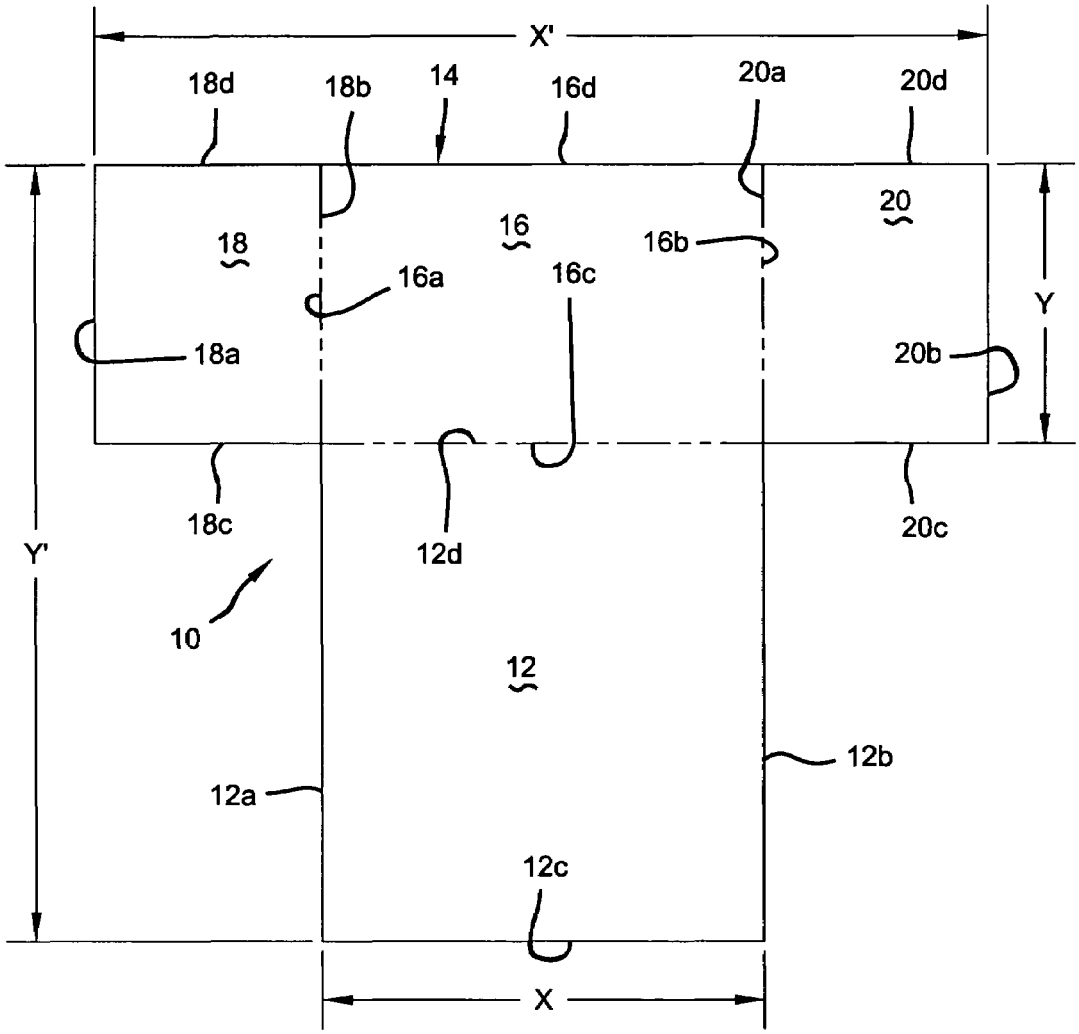
FIG. 3 is a plan view of the chair cover of FIG. 1.

FIGS. 1–3 depict a chair cover 10 in accordance with the principles of the present invention. The chair cover 10 is a one-piece flexible member including a curtain portion 12 and a belt portion 14. As depicted in FIG. 3 in an unfolded state, the chair cover 10 is substantially T-shaped. Prior to assembly, the belt portion 14 extends generally perpendicular to the curtain portion 12. Upon assembly, the belt portion 14 is wrapped around and tied behind a seatback 24 of a chair 22. As shown in FIGS. 1 and 2, the curtain portion 12 is adapted to drape from the belt portion 14 and cover a backside of the chair 22 in a decorative manner. It is envisioned that the chair cover 10 may be made of a reusable or disposable plastic, paper, fabric, or any other material capable of serving the principles of the present invention.

The curtain portion 12 includes a first longitudinal boundary 12*a*, a second longitudinal boundary 12*b*, a first transverse boundary 12*c*, and a second transverse boundary 12*d*. It should be appreciated that the second transverse boundary 12*d* is not an edge. The second transverse boundary 12*d* serves only to identify the boundary between the curtain portion 12 and the hood portion 16 and is, therefore, depicted in FIG. 3 as an imaginary line. The first longitudinal boundary 12*a* of the curtain portion 12 is substantially parallel to the second longitudinal boundary 12*b* and is displaced a distance X therefrom. In an exemplary embodiment, the distance X is between approximately 12 and 24 inches. The distance X is approximately 18 inches when the chair cover 10 is intended for a traditional folding metal chair, as depicted.

The belt portion 14 of the chair cover 10 is generally rectangular and includes a hood portion 16, a first arm portion 18, and a second arm portion 20. The hood portion 16 is generally rectangular and includes a first longitudinal boundary 16*a*, a second longitudinal boundary 16*b*, a first transverse boundary 16*c*, and a second transverse boundary 16*d*. It should be appreciated that the first longitudinal boundary 16*a*, the second longitudinal boundary 16*b*, and the first transverse boundary 16*c* of the hood portion 16 are not edges. These boundaries serve only to identify the boundaries between the first arm portion 18, second arm portion 20, and curtain portion 12 and are, therefore, depicted in FIG. 3 as imaginary lines.

The first longitudinal boundary 16*a* of the hood portion 16 is substantially parallel to the second longitudinal boundary 16*b* and is displaced the distance X therefrom. As stated above, in an exemplary embodiment, the distance X is between approximately 12 and 24 inches. The first transverse boundary 16*c* is generally parallel to the second transverse boundary 16*d* of the hood portion 16 and is displaced a distance Y therefrom. In an exemplary embodiment, the distance Y is between approximately 6 and 12 inches. The distance Y is approximately 9 inches when the chair cover 10 is intended for a traditional folding metal chair, as depicted. The second transverse boundary 16*d* of the hood portion 16 is also generally parallel to the first transverse boundary 12*c* of the curtain portion 12 and is displaced a distance Y' therefrom. In an exemplary embodiment, the distance Y' is between approximately 36 and 48 inches. The distance Y' is approximately 40 inches when the chair cover 10 is intended for a traditional folding metal chair, as depicted.

The first arm portion 18 of the belt portion 14 is generally rectangular and includes a first longitudinal boundary 18*a*, a second longitudinal boundary 18*b*, a first transverse boundary 18*c*, and a second transverse boundary 18*d*. The first longitudinal boundary 18*a* is generally parallel to the second longitudinal boundary 18*b*. It should be appreciated that the second longitudinal boundary 18*b* is not an edge. The second longitudinal boundary 18*b* serves only to identify the boundary between the first arm portion 18 and the hood portion 16 and is, therefore, depicted as an imaginary line in FIG. 3. The first transverse boundary 18*c* of the first arm portion 18 is generally parallel to the second transverse boundary 18*d* and is displaced the distance Y therefrom. Furthermore, the first transverse boundary 18*c* of the first arm portion 18 extends generally perpendicular to the first longitudinal boundary 12*a* of the curtain portion 12 and the first longitudinal boundary 16*a* of the hood portion 16. The second transverse boundary 18*d* of the first arm portion 18 extends generally perpendicular to the first longitudinal boundary 16*a* of the hood portion 16 and is substantially aligned with the second transverse boundary 16*d* of the hood portion 16.

The second arm portion 20 of the belt portion 14 is generally rectangular and includes a first longitudinal boundary 20*a*, a second longitudinal boundary 20*b*, a first transverse boundary 20*c*, and a second transverse boundary 20*d*. The first longitudinal boundary 20*a* is generally parallel to the second longitudinal boundary 20*b*. It should be appreciated that the first longitudinal boundary 20*a* is not an edge. The first longitudinal boundary 20*a* serves only to identify the boundary between the second arm portion 20 and the hood portion 16 and is, therefore, depicted in FIG. 3 as an imaginary line. The first transverse boundary 20*c* of the second arm portion 20 is generally parallel to the second transverse boundary 20*d* and is displaced the distance Y therefrom. Furthermore, the first transverse boundary 20*c* of the second arm portion 20 extends generally perpendicular to the second longitudinal boundary 12*b* of the curtain portion 12 and the second longitudinal boundary 16*b* of the hood portion 16. The second transverse boundary 20*d* of the second arm portion 20 extends generally perpendicular to the second longitudinal boundary 16*b* of the hood portion 16 and is generally aligned with the second transverse boundary 16*d* of the hood portion 16.

The second longitudinal boundary 20*b* of the second arm portion 20 is generally parallel to the first longitudinal boundary 18*a* of the first arm portion 18 and is displaced a distance X' therefrom. In an exemplary embodiment, the distance X' is between approximately 42 and 54 inches. The distance X' is approximately 48 inches when the chair cover 10 is intended for a traditional folding metal chair, as depicted.

FIGS. 1 and 2 depict the chair cover 10 assembled onto a chair 22. The chair 22 generally includes a seatback 24, a seat bottom 26, a pair of front legs 28, and a pair of rear legs 30. The seatback 24 includes a seating surface 24*a* and a top edge 24*b*. The hood portion 16 of the belt portion 14 of the chair cover 10 engages the seating surface 24*a* of the seatback 24. The chair cover 10 folds along the second transverse boundary 12*d* of the curtain portion 12, which is also the first transverse boundary 16*c* of the hood portion 16, over the top edge 24*b* of the seatback 24. The curtain portion 12 hangs from the seatback 24 to cover a backside of the chair 22, as illustrated in FIG. 1.

The first arm portion 18 of the belt portion 14 folds along its second longitudinal boundary 18*b* and extends behind the seatback 24. Likewise, the second arm portion 20 of the belt portion 14 folds along its first longitudinal boundary 20*a* and extends behind the seatback 24. The first arm portion 18 and the second arm portion 20 are affixed to maintain the hood portion 16 in engagement with the seating face 24*a* of the seatback 24 and the chair cover 10 on the chair 22. As shown, the arm portions 18, 20 are tied into a decorative bow, but other means or methods of securing the arm portions 18, 20 together are intended to be within the scope of the present invention.

Figure 4:
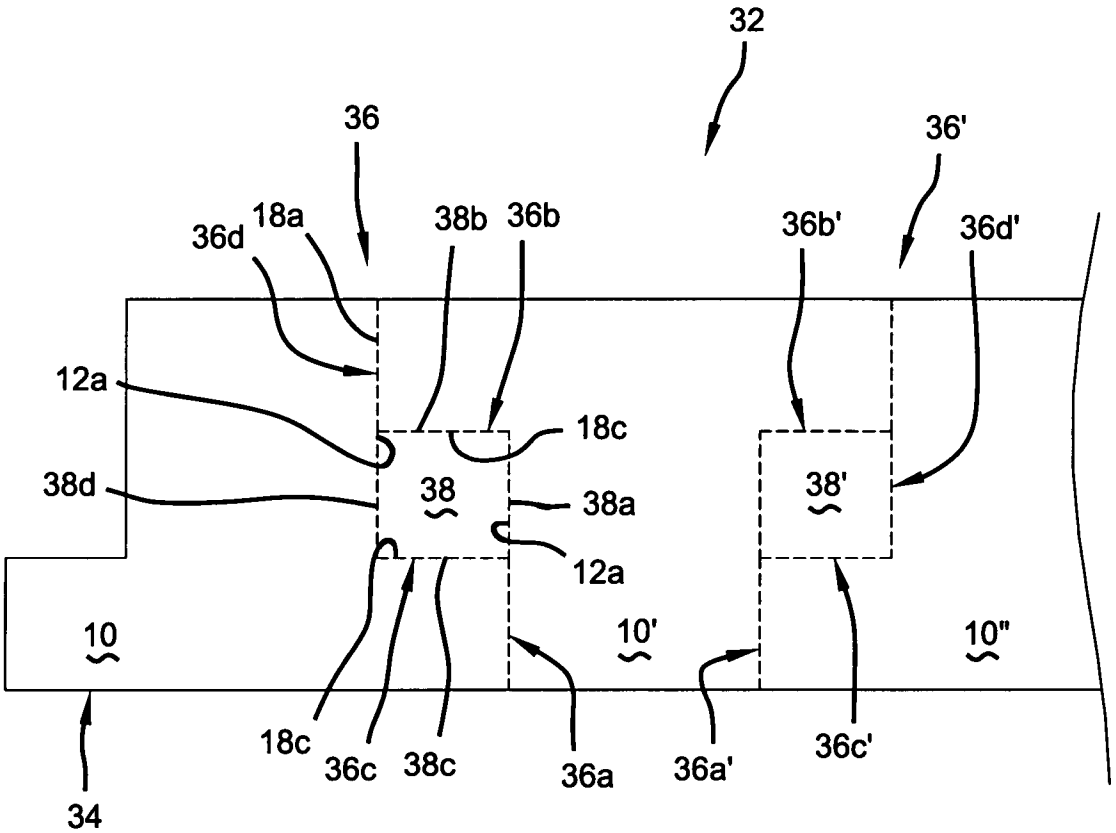
FIG. 4 is a plan view of a chair covering product in accordance with the principles of the present invention.

FIG. 4 depicts a chair covering product 32 in accordance with the principles of the present invention. The chair covering product 32 generally includes an elongated sheet 34 of material such as plastic, paper, fabric, or any other material capable of serving the principles of the present invention. The elongated sheet 34 includes a plurality of perforated regions 36. The plurality of perforated regions 36 define a plurality of waste panels 38 and a plurality of chair covers 10. The chair covering product 32 may be packaged on a roll, similar to paper towel or wrapping paper. This type of packaging reduces the potential for creasing the chair covers 10 in undesirable locations during storage and/or shipment. The user may then unroll the sheet 34 and tear along the perforated regions 36 to retrieve an appropriate number of chair covers 10 for a specified occasion.

For the sake of brevity, FIG. 4 depicts a chair covering product 32 including the elongated sheet 34 having a first perforated region 36 and a second perforated region 36'. The first and second perforated regions 36, 36' define three chair covers 10, 10', and 10" and two waste panels 38 and 38'. It should be appreciated that a covering product 32 having more than two perforated regions 36 defining more than three chair covers 10 is intended to be packaged to a consumer. For example, an exemplary chair covering product 32 is envisioned to include 10, 25, 50, or even 100 chair covers 10. It should further be appreciated that the second chair cover 10' is simply an inverted version of the first 10 and third 10" chair covers.

The first perforated region 36 includes a first seam 36*a*, a second seam 36*b*, a third seam 36*c*, and a fourth seam 36*d*.

The first seam 36*a* includes the first longitudinal boundary 12*a* of the curtain portion 12 of the second chair cover 10', the first longitudinal boundary 18*a* of the first arm portion 18 of the first chair cover 10, and a first boundary 38*a* of the first waste panel 38. The second seam 36*b* of the first perforated region 36 includes the first transverse boundary 18*c* of the first arm portion 18 of the second chair cover 10' and a second boundary 38*b* of the first waste panel 38. The third seam 36*c* includes the first transverse boundary 18*c* of the first arm portion 18 of the first chair cover 10 and a third boundary 38*c* of the first waste panel 38. The fourth seam 36*d* includes the first longitudinal boundary 12*a* of the curtain portion 12 of the first chair cover 10, the first longitudinal boundary 18*a* of the first arm portion 18 of the second chair cover 10', and a fourth boundary 38*d* of the first waste panel 38.

A user tears the chair covering product 32 along the first seam 36*a*, the second seam 36*b*, and a portion of the fourth seam 36*d* to remove the first waste panel 38 and the first chair cover 10 from the elongated sheet 34. Subsequently, the user tears along the third seam 36*c* and the remaining portion of the fourth seam 36*d* to remove the first waste panel 38 from the first chair cover 10. The first chair cover 10 can then be assembled onto a chair 22, as described above with reference to FIGS. 1 and 2.

The second perforated region 36' includes a first seam 36*a'*, a second seam 36*b'*, a third seam 36*c'*, and a fourth seam 36*d'*. It should be appreciated that the second perforated region 36' is simply an inverted version of the first perforated region 36. It should further be appreciated that a user removes the second chair cover 10' from the chair covering product 32 by tearing the elongated sheet 34 along the second perforated region 36' in a manner similar to that described above with reference to the first chair cover 10. Therefore, it should be understood that the chair cover 10 and chair covering product 32 of the present invention provide a simple, inexpensive chair cover 10 that is capable of easily being mass produced and supplied in great numbers to consumers. Additionally, the chair cover 10 and chair covering product 32 provides the advantage of being able to be constructed of a variety of materials, and allows a selectively reusable or a disposable chair cover 10.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A cover for a chair having a seatback and a backside, comprising:

a one-piece member including seamless boundaries between a curtain portion, a hood portion, and a belt portion on the one-piece member, the curtain portion being adapted to cover the backside of the chair, the hood portion extending from the curtain portion and folded onto itself to partially define a pocket adapted to cover a top portion of the seatback, and the belt portion including a first arm portion extending from a first edge of the hood portion and a second arm portion extending from a second edge of the hood portion that is opposite the first edge, the first arm portion and the second arm portion further defining the pocket.

2. The chair cover of claim 1 wherein the member is generally T-shaped.

3. The chair cover of claim 1 wherein the member is a flexible member.

4. The chair cover of claim 1 wherein the curtain portion is larger than the belt portion.

5. A decorative chair, comprising:

a seat bottom;

a seatback having a seating face and a back face opposite the seating face, the seatback being supported generally upright on the seat bottom; and a member having a curtain portion covering the back face of the seatback and a belt portion including:

a hood portion partially defining a pocket adapted to cover a top portion of the seatback; and a pair of arm portions extending from opposite edges of the hood portion and further defining the pocket, the arm portions being fixed together behind the curtain portion of the cover and the back face of the seatback to maintain the hood portion in engagement with the seating face and the member on the chair.

6. The decorative chair of claim 5 further comprising a plurality of legs supporting the seat bottom, wherein the curtain portion extends to cover at least one of the plurality of legs.

7. The decorative chair of claim 5 wherein the member is substantially T-shaped.

8. The decorative chair of claim 5 wherein the member is a flexible member.

9. The chair cover of claim 5 wherein the curtain portion of the member is larger than the belt portion.

10. A chair covering product, comprising:

a first member including a first curtain portion and first and second opposing arm portions;

a second member including a second curtain portion and third and fourth opposing arm portions;

a first perforated seam disposed between the first curtain portion of the first member and one of the third and fourth arm portions of the second member; and a second perforated seam disposed between the second curtain portion of the second member and one of the first and second arm portions of the first member.

11. The chair covering product of claim 10 further comprising a first waste portion disposed between the first and second members and partially defined by the first and second perforated seams.

12. The chair covering product of claim 10 wherein the first and second members are substantially T-shaped.

13. The chair covering product of claim 10 wherein the first and second members are flexible members.

14. The chair covering product of claim 10 wherein the first and second arm portions extend substantially perpendicular to the first curtain portion and the third and fourth flexible arm portions extend substantially perpendicular to the second curtain portion.

15. The chair covering product of claim 10 wherein the first member further includes a first hood portion disposed between the first and second arm portions and the second member further includes a second hood portion disposed between the third and fourth arm portions, the first and second hood portions being adapted to engage a seatback of a chair.

* * * * *